US009499952B2

(12) United States Patent
Nakaniwa et al.

(10) Patent No.: US 9,499,952 B2
(45) Date of Patent: Nov. 22, 2016

(54) SYSTEM AND METHOD FOR PROVIDING INFORMATION TO OPERATOR OF PILE DRIVER

(71) Applicants: KANSAI KOUJI SOKURYOU CO., LTD., Minoo-shi, Osaka (JP); NIPPON STEEL & SUMITOMO METAL CORPORATION, Chiyoda-ku, Tokyo (JP)

(72) Inventors: Kazuhide Nakaniwa, Minoo (JP); Yukio Abe, Chiyoda-ku (JP)

(73) Assignees: KANSAI KOUJI SOKURYOU CO., LTD., Minoo-Shi, Osaka (JP); NIPPON STEEL & SUMITOMO METAL CORPORATION, Chiyoda-Ku, Tokyo (JP)

( * ) Notice: Subject to any disclaimer, the term of this patent is extended or adjusted under 35 U.S.C. 154(b) by 24 days.

(21) Appl. No.: 14/414,524

(22) PCT Filed: Jul. 12, 2013

(86) PCT No.: PCT/JP2013/069160

§ 371 (c)(1),
(2) Date: Jan. 13, 2015

(87) PCT Pub. No.: WO2014/010729

PCT Pub. Date: Jan. 16, 2014

(65) Prior Publication Data

US 2015/0184353 A1 Jul. 2, 2015

(30) Foreign Application Priority Data

Jul. 13, 2012 (JP) ..... 2012-158066

(51) Int. Cl.
*G06F 7/70* (2006.01)
*E02D 11/00* (2006.01)
*E02D 13/06* (2006.01)

(52) U.S. Cl.
CPC ..... *E02D 11/00* (2013.01); *E02D 13/06* (2013.01)

(58) Field of Classification Search
CPC ..... E02D 11/00; E02D 13/06
USPC ..... 701/50; 356/3.01; 33/290, 292
See application file for complete search history.

(56) References Cited

U.S. PATENT DOCUMENTS 7,996,998 B2 8/2011 Nakaniwa
8,527,155 B2 * 9/2013 Gudat ..... E02F 9/2054 701/50

(Continued)

FOREIGN PATENT DOCUMENTS

JP 6-057746 A 3/1994
JP 6-101230 A 4/1994

(Continued)

OTHER PUBLICATIONS

International Preliminary Report on Patentability (PCT/IB/338, PCTIB/373, PCTSA/210) mailed on Jan. 13, 2015, by the Japanese Patent Office as the International Searching Authority for International Application No. PCT/JP2013/069160.

(Continued)

*Primary Examiner* — Thomas G Black
*Assistant Examiner* — Luke Huynh
(74) *Attorney, Agent, or Firm* — Buchanan Ingersoll & Rooney PC

(57) ABSTRACT

A system and method for precisely controlling an amount of tilt of a plumb pile or a batter pile without using two surveying instruments or a clinometer. The system for providing operational information to an operator of a pile driver 10 for driving a pile 101 into the ground has first means 14 for obtaining first data of tilt of the pile in a first coordinate system, a second means 16 for converting the first data into a second data in a second coordinate system defined by at least two points Pl, Pr, and display means 17 for displaying the amount of tile in the second coordinate system.

14 Claims, 17 Drawing Sheets

(56) References Cited

U.S. PATENT DOCUMENTS

| | | | | |
|---|---|---|---|---|
| 2001/0039740 | A1* | 11/2001 | Kaneko | G02B 7/34 33/290 |
| 2010/0095539 | A1* | 4/2010 | Nakaniwa | G01C 15/002 33/284 |

FOREIGN PATENT DOCUMENTS

| | | | |
|---|---|---|---|
| JP | 2002-021077 | A | 1/2002 |
| JP | 2008-121219 | A | 5/2008 |
| JP | 2009-068282 | A | 4/2009 |
| JP | 2009-092419 | A | 4/2009 |
| JP | 4441561 | B2 | 3/2010 |

OTHER PUBLICATIONS

International Search Report (PCT/ISA/210) mailed on Aug. 6, 2013, by the Japanese Patent Office as the International Searching Authority for International Application No. PCT/JP2013/069160.
m

* cited by examiner

103:AUXILIAR CRANE
104: AUGER MOTOR
PILEDRIVER 10
105: VOTARY CAP
101
102
106
107
108
10
AUGER MOTOR 104
RESTING ARM 106
PILEDRIVER 10
105:VOTARY CAP

POSITION OF SURVEYING INSTRUMENT
17
PILE CENTER AT REFERENCE LEVEL
POSITION OF PILEDRIVER
21
22
ey
ex
0.1 DEGREES
0.2 DEGREES
OBSERVATION
CAP
SET
DETAILS
SUSPEND
STOVE
24
20
23
-0.1 DEGREES
0.0 DEGREES
REAR
FRONT
0.2 DEGREES
0.0 DEGREES
LEFT
RIGHT
MEASURED VALUE
DESIGN VALUE
MEASURED VALUE

Y
X
ECCENTRICITY (XY)
EX +(−) ???mm
EY +(−) ???mm

−
+
ROTATION
+(−) ??? DEGREES

−
+
TILT
+(−) ??? DEGREES 101
103
110
111
112
113
114
115
116
Pl
Pr

SYSTEM AND METHOD FOR PROVIDING INFORMATION TO OPERATOR OF PILE DRIVER

TECHNICAL FIELD

The present invention relates to a system and method for providing information to an operator of a pile driver.

BACKGROUND

A piling needs a proper control of pile tilt. Conventionally, when driving a pile vertically into the ground (without tilt), a method is employed in which the tilt is observed from two orthogonal horizontal directions by two surveying instruments to correct the tilt of the driving pile. When driving a pile obliquely into the ground at a certain angle, a surveying instrument is positioned on a vertical plane including the longitudinal axis of the pile to observe the leftward or rightward tilt of the pile and, at the same time, an inclinometer is used to measure the tilting angle of the pile and then correct if any tilting angle error using the measurements.

PRIOR ART DOCUMENTS

Document 1: JP 2009-068262 A
Document 2: JP 06-057746 A

The former method needs two surveying instruments. The latter method has a drawback that it may be difficult to set the inclinometer in a vertical plane including the longitudinal axis of the pile and therefore and, as a result, to obtain an accurate tilting angle of the pile.

Another technique is proposed in Document 1 which indicates a tilting angle of the pile guide using an angle indicator. Also, another technique is proposed in Document 2 which uses a tilt sensor to detect the tilting angle of the pile guide. Those techniques need the dedicated angle indicator and tilt sensor.

Accordingly, the present invention is to provide a system and method for controlling a tilt of plumb pile (vertical pile) or batter pile (oblique pile) in an accurate manner without using two surveying instruments or tilt sensor.

SUMMARY OF THE INVENTION

For this purpose, a system of the invention is to provide an operator of a pile drive for driving a pile into the ground with an operational information necessary for operating the pile driver, which includes first means for obtaining first data of tilt of the pile in a first coordinate system, a second means for converting the first data into a second data in a second coordinate system defined by at least two points, and display means for displaying the amount of tile in the second coordinate system.

Also, a method of the invention is to provide an operator of a pile drive for driving a pile into the ground with an operational information necessary for operating the pile driver, which comprises obtaining a first data relating to a tilt of the pile in a first coordinate system, converting the first data into a second data in a second coordinate system defined by at least two points, and displaying the tilt of the pile in the second coordinate system using the second data.

According to the system, the tilt of the plumb pile or the batter pile can be controlled precisely without any need to use two surveying instruments or tilt meter.

PREFERRED EMBODIMENTS OF THE INVENTION

With reference to the accompanying drawings, an embodiment of a system and method for providing information (i.e., pile tilt information) to an operator of a pile driver for driving a pile into the ground.

1. Pile Driver

Figure 1:
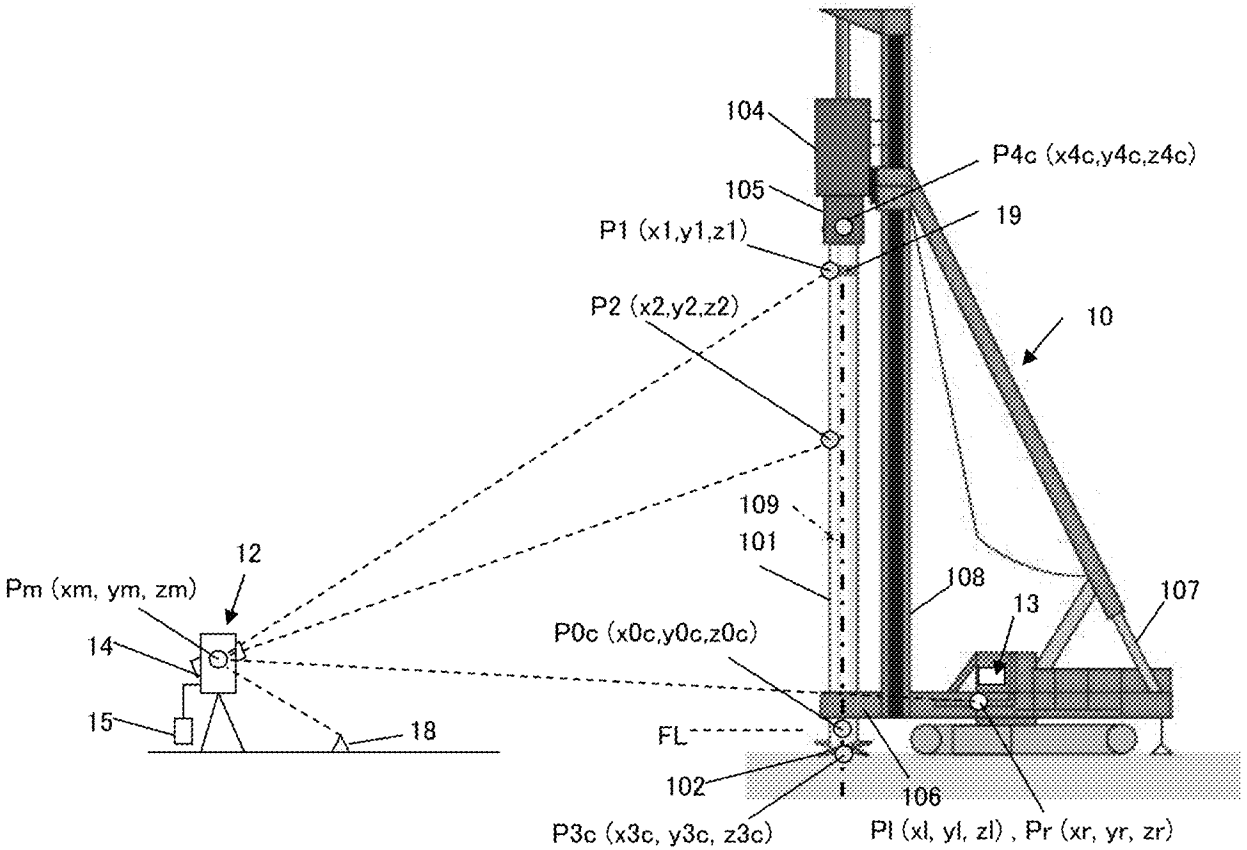
FIG. 1 is a diagram showing an operation of pile driving which uses a system according to the present invention.
Figures 2A, 2B, 2C, 2D:
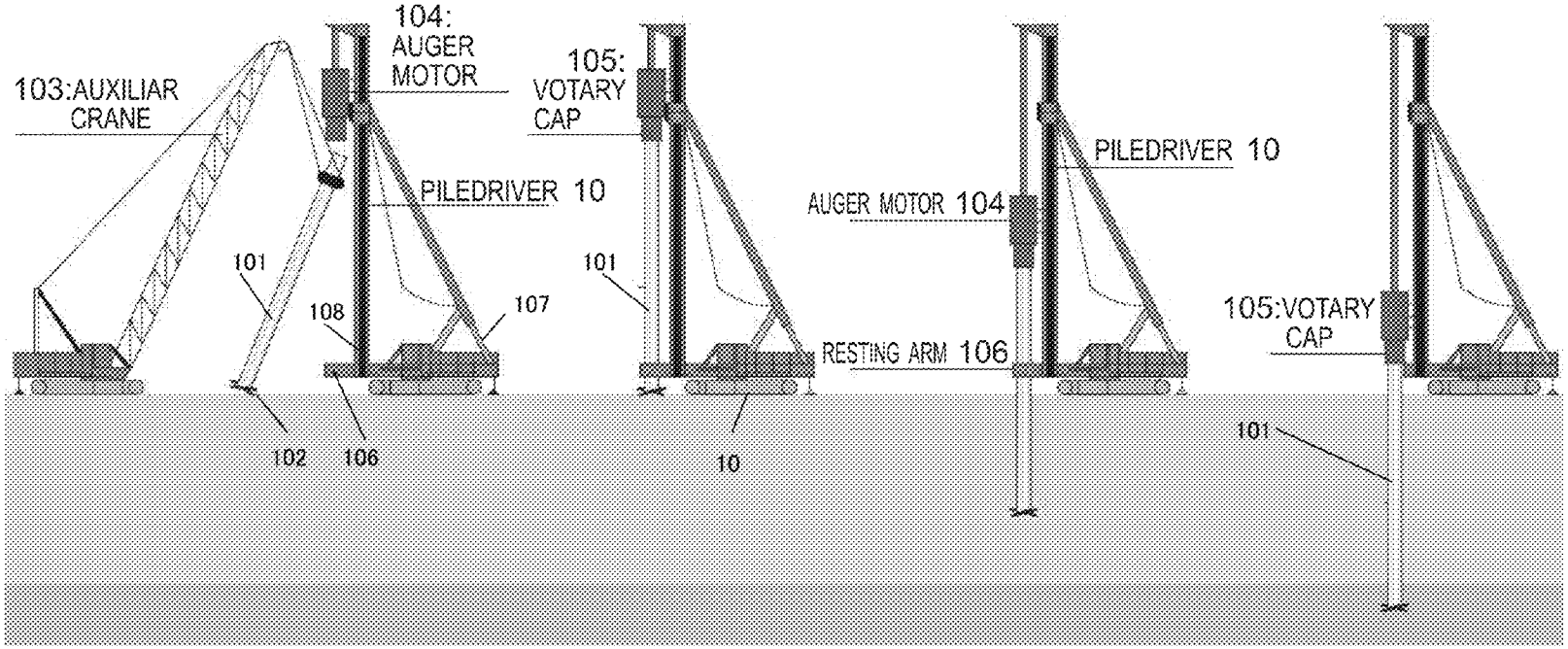
FIGS. 2A-2D are diagrams showing the pile driving operation.

FIG. 1 shows an embodiment of the pile driver, generally indicated by reference numeral 10, incorporating a system according to the present invention. Preferably, the pile driver 10 is a three-point suspension pile driver which is developed by Sumitomo Metal Industries, Ltd. and used for a rotary steel-pile driving method (GWPII) under the brand name "GEO WING PILE II". The pile 101 used in this method has a steel pile with two substantially conical wings 102 provided at distal or lowermost end of the pile. When driving, as shown in FIGS. 2A to 2D, a pile 101 is set on the three point suspension pile driver 10 using an auxiliary crane 103 and then a rotary cap 105 drivingly connected to an auger motor 104 of the pile driver 10 is placed on the top of the pile 101. Next, the pile 101 is held at its lower portion by a resting arm 106 and then placed with its center at target driving position. Once the preparations are completed, the auger motor 104 is energized to rotate the pile 101 and drive it into the ground until it reaches a predetermined depth. A typical length of the pile is about 10 meters. Therefore, when forming 30 meter long pile in the ground, two another steel piles (without wings) are added on the top of the first pile 101. While driving the pile 101, a tilt of the pile 101 is measured by a method which will be described below and, if necessary, the tilt of the guide column 108 is controlled by driving left and/or right hydraulic cylinder 107.

2. System Configuration

Figure 3:
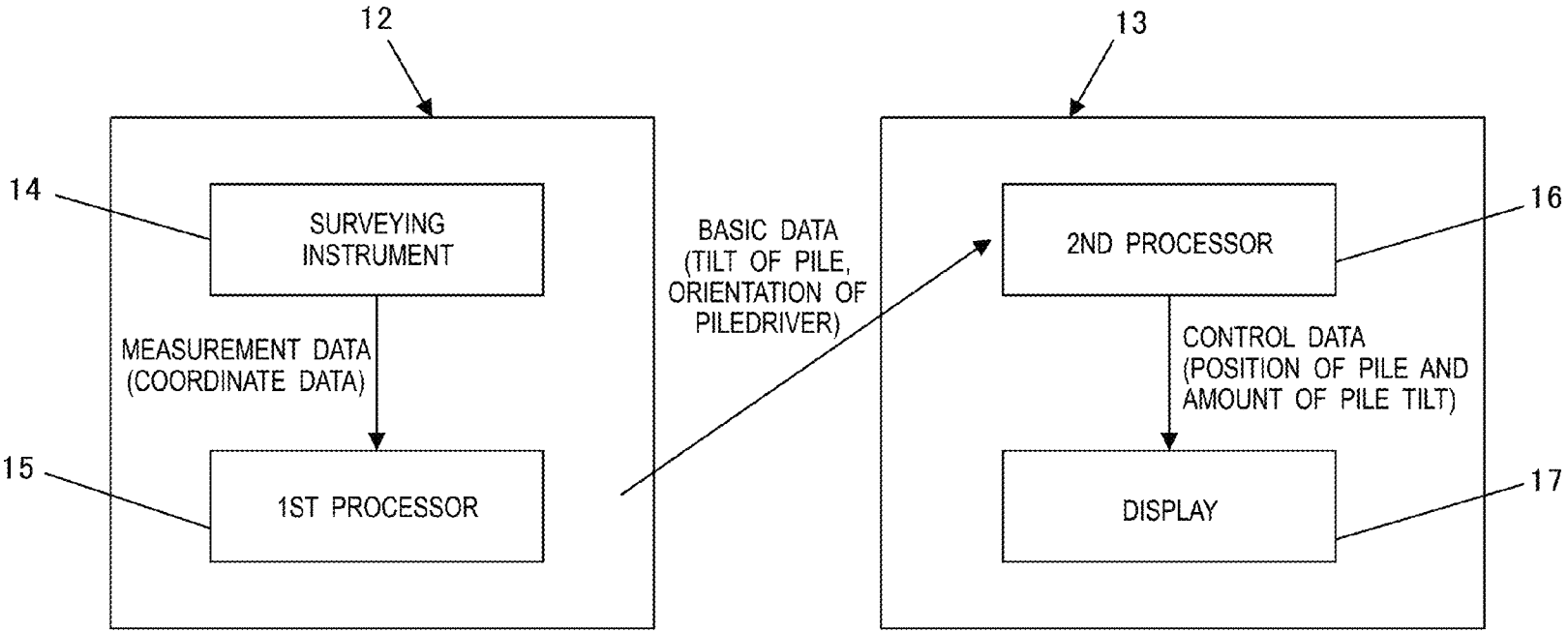
FIG. 3 is a diagram showing a structure of the system according to the invention and a data flow.

FIG. 3 shows a system, generally indicated by reference numeral 10, for providing tilt information of the pile to an operator of the pile driver 10, which will be used for controlling the tilt angle of the pile 101. As shown in the drawing, the system 1 has a first subsystem 12 which obtains a basic data relating to a tilt of the pile 101 and an orientation of the pile driver 10 and a second subsystem 13 which uses the basic data obtained by the first subsystem 12 and obtains necessary control data which allows the operator of the pile driver 10 to operate the pile driver 10 and control the tilt angle of the pile 101 at a target value.

As shown in FIG. 1, the first subsystem 12 has a surveying instrument 14 which is provided a position away from the pile driver 10. For example, the surveying instrument 14 is a total station commercially available from Leica Geosystems AG under the tradename Viva Series "TRINOS", which incorporates a central coordinate measuring technique TRINOS® allowing a central coordinate of an inaccessible cylindrical structure to be measured accurately and easily. The central coordinate measuring technique, which is described in detail in JP 4,441,561 B and the counterpart U.S. Pat. No. 7,996,998, is used to measure the central coordinates and defined the central axis of the cylindrical structure positioned away from the structure. With this technique, the central coordinates of the pile collimated by the dedicated total station readily and reliably obtained. A structure of the surveying instrument 14 relating to the central coordinate measuring technique and a measuring method using the same will be described later.

Referring to FIG. 3, the surveying instrument 14 is connected to a first processor or computer equipped with a communication function. In the drawing, the surveying instrument 14 is wired to a first processor 15 for communication therewith, however; they may be connected for communication by wireless. As will be described in detail below, measurement data transmitted from the surveying instrument 14 includes, for example, coordinate data of target collimation points (P1, P2) provided on the pile 101 supported by the pile driver 10 and coordinate data of two points (Pl, Pr) provided on the pile driver 10, both obtained and collimated by the surveying instrument 14. The first processor 15 has a function to process the measurement data transmitted from the surveying instrument 14 according to a certain program and then generate basic data including the tilt of pile and the orientation of the pile driver 10 and a function to transmit the basic date by wireless.

As shown in FIG. 1, the second subsystem 13 is provided adjacent the operating section of the pile driver 10, for example, in the operating room of the pile driver 10. The second subsystem 13 has a second processor or computer 16 with a communication function and a display 17. The second processor 16 has a function to process the basic data transmitted from the first processor 15 according to a certain program. This function includes setting an operator coordinate system in which an origin of coordinate thereof is located at a position of operator in the pile driver 10, calculating a coordinate of the pile position in the operator coordinate system and an amount of tilt of the pile, and transmitting control date including to the pile position and the pile tilt. The display 17 is connected to the second processor 16 by wired or wireless communication so that it receives the control data transmitted from the second processor 16 and visually display it.

3. Operation of System

Discussions will be made to a piling operation and a system 1 related thereto.

An operator drives the surveying instrument 14 to collimate a benchmark 18 prepared within the construction area and thereby obtain a mechanical reference coordinate Pm (xm, ym, zm). A coordinate system with an origin of coordinate at the mechanical reference coordinate Pm and X, Y, and Z coordinates corresponding to east-west, north-south, and vertical directions, respectively, is referred to as basic coordinate system (first coordinate system).

The operator of the pile driver 10 moves it to a position near a piling position where the pile is to be driven into the ground. Then, the operator cooperates with another operator who is operating the auxiliary crane 103 to set the pile on the pike driver 10 (See FIG. 2A). Further, the operator of the pile driver 10 drives the pile driver 10 to place the tip or the lowermost end of the pile 101 at the predetermined piling position (x0, y0) (See FIG. 2B).

Figure 4:
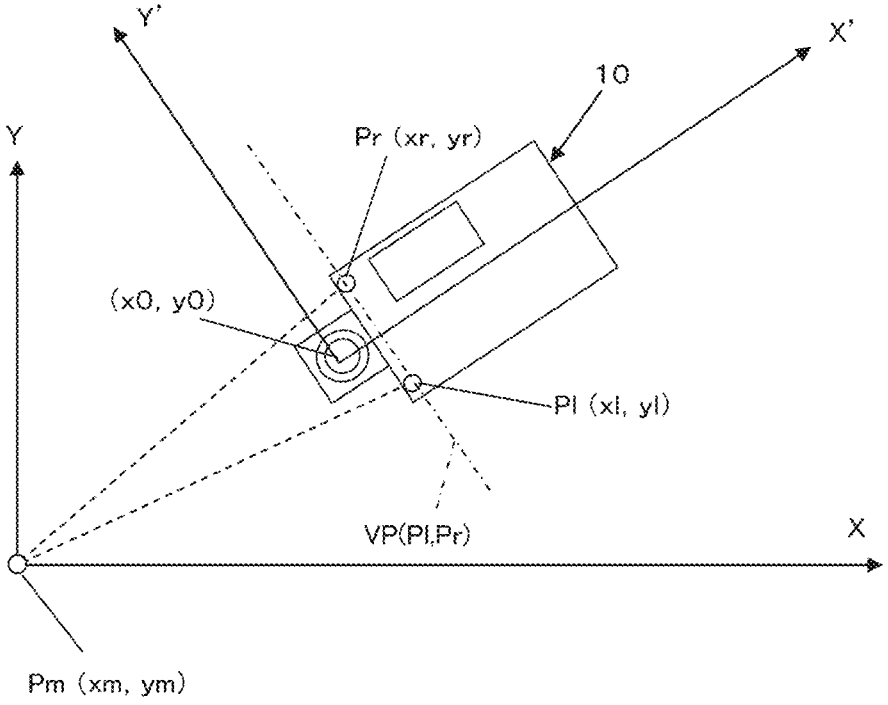
FIG. 4 is a diagram showing a relation between a first coordinate system (basic coordinate system) and a second coordinate system (operator coordinate system)

Once the above preparation is completed, as shown in FIG. 4 the operator of the surveying instrument 14 drives it to collimate the two targets Pl and Pr provided on the pile driver 10 and determine the coordinates (xl, yl) and (xr, yr) of the targets Pl and Pr, respectively, in the basic coordinate system. Preferably, as shown in the drawing the targets Pl and Pr are provided on a vertical plane which extends in a direction orthogonal to the front-back, longitudinal axis of the pile driver 10. The targets Pl and Pm may be a general-purpose mark or seal, or surveying target.

The coordinate data Pm (xm, ym, zm), Pl (xl, yl, zl), and Pr (xr, yr, zr) obtained by the surveying instrument 14, which are useful information in determining the orientation of the pile driver 10, are transmitted to the first processor 15. Using the coordinate data, the first processor 15 determines an operator coordinate system (second coordinate system). The operator coordinate system is defined by a coordinate origin defined by the piling position or reference point (x0, y0, z0) and a design reference level or height FL=z0, a first horizontal direction Y' parallel to the vertical plane VP (Pl, Pr) extending through the targets Pl and Pr, and a second horizontal direction X' orthogonal to the first horizontal direction Y', the first and second horizontal directions crossing the coordinate origin (x0, y0, z0).

After the completion of the above processes at the surveying instrument 14, the pile driver 10 is energized to drive the pile into the ground. During the piling, as shown in FIG. 1 the operator of the surveying instrument 14 drives the surveying instrument 14 to collimate two first and second central collimation points P1 and P2 of the pile 101 and obtain their coordinates (x1, y1, z1) and (x2, y2, z2), respectively. Each of the collimation points P1 and P2 appears at the center between left and right edges of the pile 101 when the pile 101 is observed through the surveying instrument 14. Preferably, as shown in FIG. 1 the first collimation point P1 is positioned on a marking 19 provided at a position a certain distance L1 away from the pile head covered by the rotary cap 105. The second collimation point P2 can be determined by the operator at a position a certain distance away from the first collimation point P1 in a direction along the longitudinal axis of the pile. The coordinate data (x1, y1, z1) and (x2, y2, z2) of the first and second collimation points P1 and P2, obtained by the surveying instrument 14 are transmitted to the first processor 15.

Figure 5A:
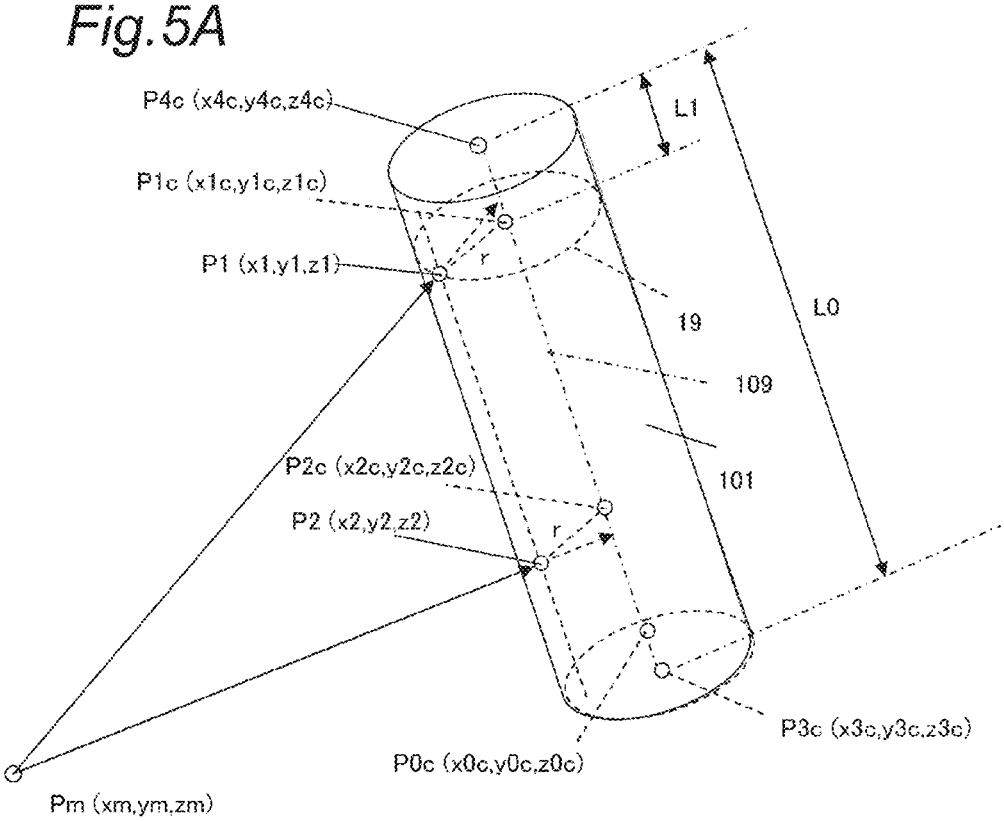
FIGS. 5A and 5B are diagrams showing a process for measuring centers of the pile.
Figure 5B:
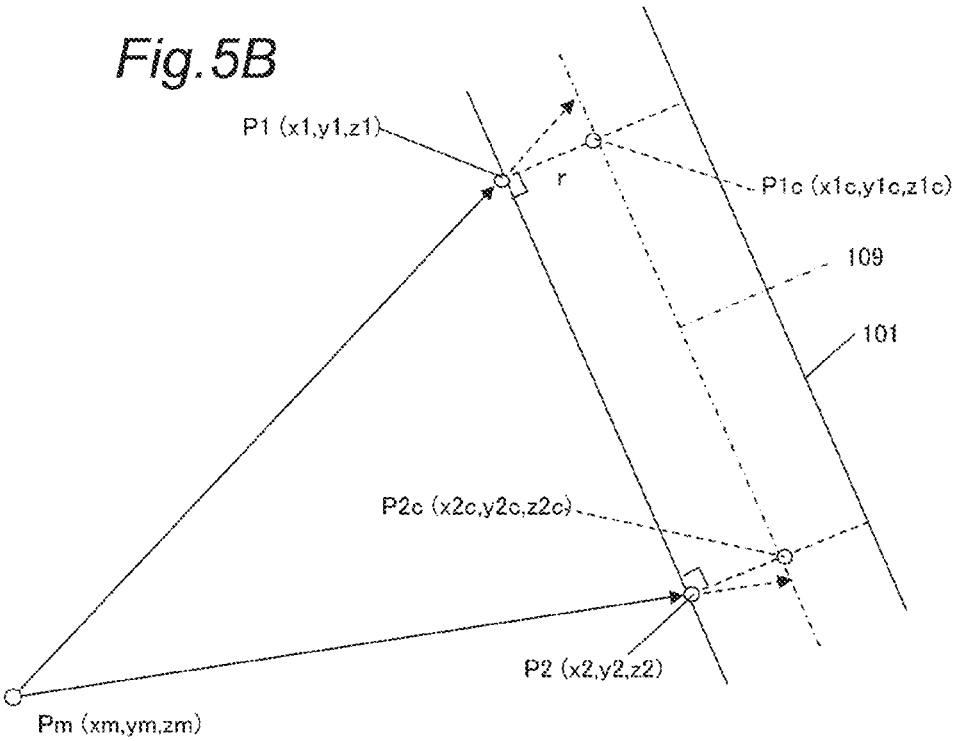

The first processor 15 uses the coordinate data (xm, ym, zm) of the mechanical reference coordinate Pm, and the coordinate data (x1, y1, z1) and (x2, y2, z2) of the first and second collimation points P1 and p2 to define a collimating plane including those three coordinates. As shown in FIGS. 5A and 5B, the collimating plane includes the longitudinal axis 109 of the pile 101. Then, the first processor 15 calculates coordinates (x1*c*, y1*c*, z1*c*) and (x2*c*, y2*c*, z2*c*) of the pile centers P1*c* and P2*c* which are spaced a radius r (known) of the pile 10 away from the first and second collimation points P1 and P2 and in a direction orthogonal to a line connecting the collimation points P1 and P2. The processor 15 further obtains an equation of the longitudinal axis 109 connecting the P1*c* and P2*c*. Further, the processor 15 uses the equation of the longitudinal axis 109, the coordinates P1*c* (x1*c*, y1*c*, z1*c*) and P2*c* (x2*c*, y2*c*, z2*c*), a distance L1 from the point P1*c* to the pile head, and a length L0 of the pile 101 (known) to determine a coordinate (x3*c*, y3*c*, z3*c*) of the distal end center P3*c* of the pile 101, a coordinate (x4*c*, y4*c*, z4*c*) of the pile head center P4*c*, and a coordinate (x0*c*, y0*c*, z0*c*) (z0*c*=0) of the center P0*c* of the pile at a level or height of the reference level FL.

Figure 6A:
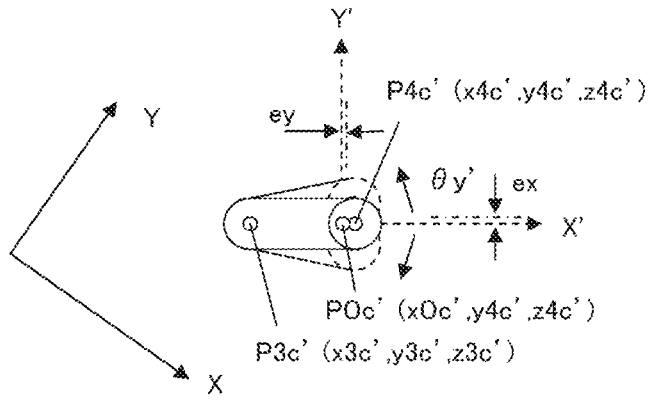
FIGS. 6A and 6B are diagrams showing a tilt of the pile.
Figure 6B:
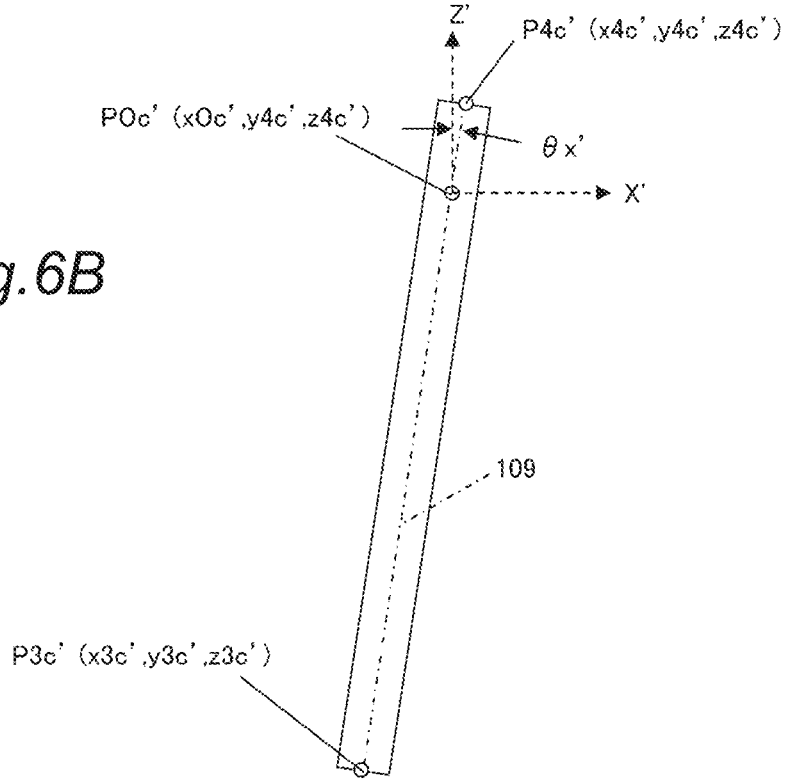

The basic coordinate system data (x3*c*, y3*c*, z3*c*), (x4*c*, y4*c*, z4*c*), and (x0*c*, y0*c*, z0*c*) of P3*c*, P4*c*, and Pc, respectively, obtained by the first processor 15, which are useful in determining the amount of tilt of the pile 101, are transmitted to the second processor 16. Then, the second processor 16 converts the received, basic coordinate system data (x3*c*, y3*c*, z3*c*), (x4*c*, y4*c*, z4*c*), and (x0*c*, y0*c*, z0*c*) into coordinate data (x3*c*', y3*c*', z3*c*'), (x4*c*', y4*c*', z4*c*'), and (x0*c*', y0*c*', z0*c*') in the operator coordinate system (see FIGS. 6A and 6B) which are then used in determining the amount of tilt of the pile 101 in the operator coordinate system.

The second processor 16 calculates amounts of tilt (i.e., measured tilt angles θx' and θy') in the front-back or longitudinal or direction (X'-direction) and in the left-right or lateral direction (Y'-direction) (see FIG. 6), and tilt errors which are the differences between the designed tilt angles θx and θy and the measured tilt angles θx' and θy', i.e., δθx (=θx−θx') and θy (=θy−θy'). Also, the second processor 16 calculates eccentricities ex (=x0*c*−x0*c*') and ey (=y0*c*−y0*c*') between the designed coordinate (x0*c*, y0*c*) and the measured coordinate (x0*c*', y0*c*') of the pile center. Typically, when driving a batter (oblique) pile, the pile driver 10 drives the left and right hydraulic cylinders 107 so that the leftward and rightward tilts θy' become zero while the tilt angle of the guide column 108 or its longitudinal axis is kept in parallel to that of the driving pile.

Figures 7A, 7B, 7C, 7D:
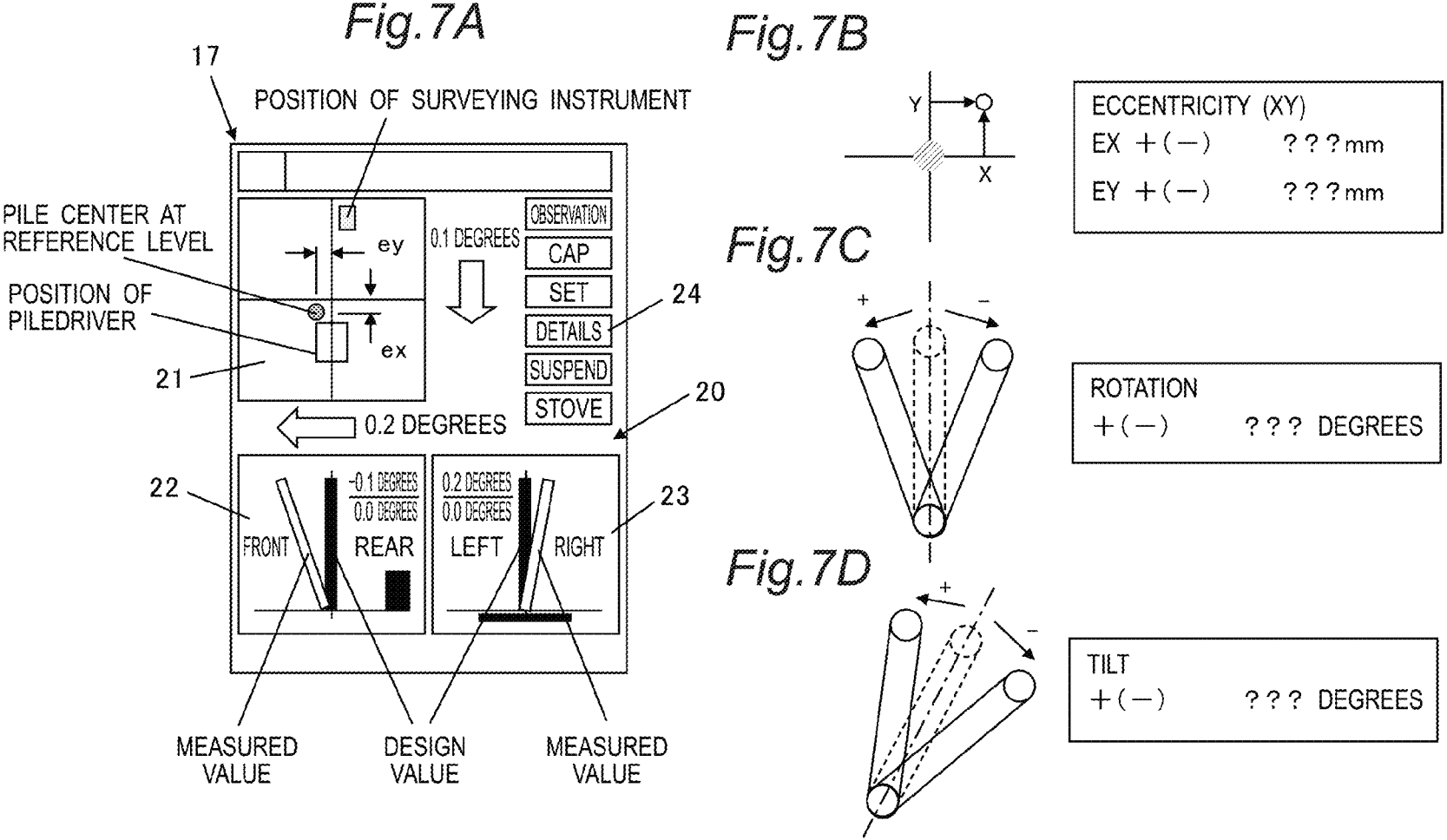
FIGS. 7A to 7D are diagrams showing indications in a display unit.
Figure 8:
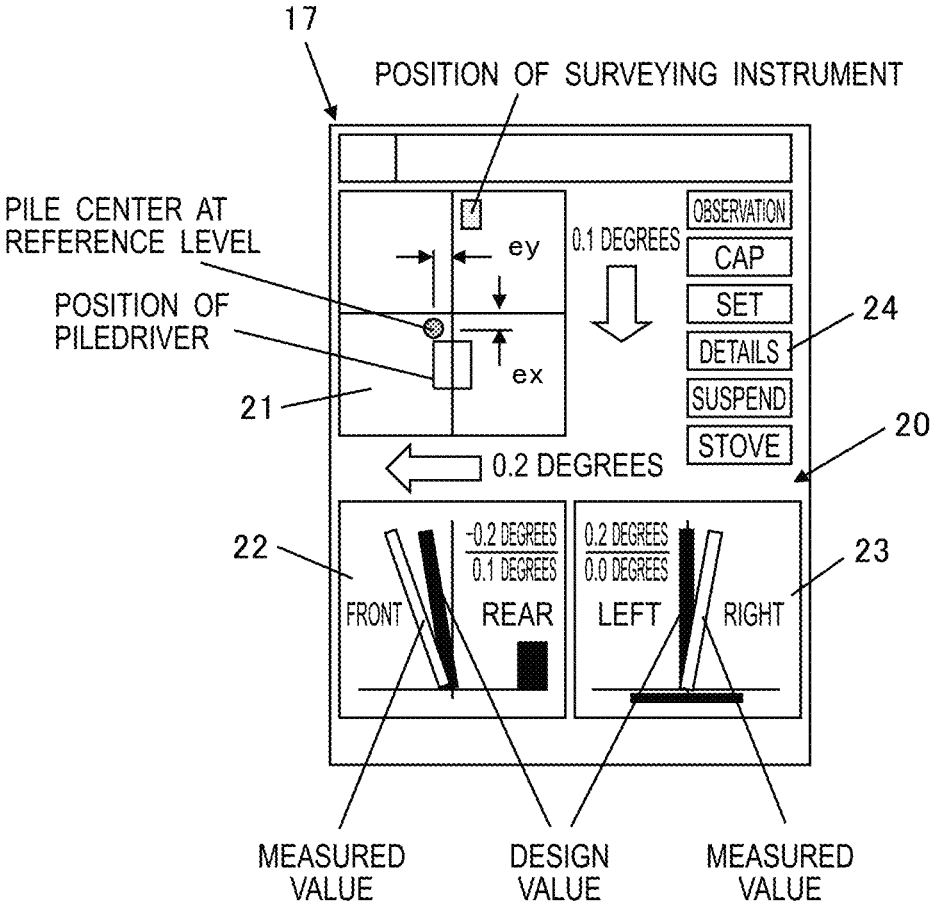
FIG. 8 is a diagram showing another screen of the display unit.

The second processor 16 transmits the amounts of tilt or tilt errors δθx and δθy and the eccentricities ex and ey to the display 17. The display 17 displays the tilt errors δθx and δθy and the eccentricities ex and ey. FIGS. 7A to 7D show an example of the display screen image on the display 17. As shown, a viewing area 20 of the display 17 has three displaying sections 21, 22, and 23. The section 21 is configured to display the pile center eccentricities ex and ey at the basic reference level FL. The section 22 is configured to display the tilt error δθx in the X'-direction (longitudinal direction of the pile driver) in the operator coordinate system. The section 22 in FIG. 7A shows a design value of plumb pile which is driven vertically into the ground while the section 22 in FIG. 8 shows a design value of batter pile. The section 23 is configured to display the tilt error δθy in the Y'-direction (lateral direction of the pile driver) in the operator coordinate system.

The screen 20 of the display 17 may be provided with a number of mode setting keys. For example, according to the embodiment a detailed data indicating key 24 is provided for, when it is pressed, changing the display content to indicate the eccentricities ex and ey in the X- and Y-directions at the basic reference level FL and the tilt errors δθx and δθy in the longitudinal and lateral directions, in a different manner.

During the pile driving, the surveying instrument 14 obtains coordinate data (x1, y1, z1) and (x2, y2, z2) of collimation points P1 and P2, respectively, at a suitable time interval. The collimation point P1 is always on the collimation marking 19 while the collimation point P2 may be altered in each surveying. As described above, the first processor 15 uses the coordinate data (x1, y1, z1), (x2, y2, z2), and (xm, ym, zm), distance from the pile center P1*c* to the pile top, and length of the pile L0 to determine the coordinate data (x3*c*, y3*c*, z3*c*), (x4*c*, y4*c*, z4*c*) and (x0*c*, y0*c*, z0*c*). The second processor 16 determines the tilt errors δθx and δθy and the eccentricities ex and ey of the pile and indicates them on the display 17.

When the pile is extended by adding another on top of it, the length of the pile L0 is updated. For example, if the first pile 101 with wings has 10 meters long and then another pile having 10 meters long is added, the pile length L0 is updated to 20 meters long which is used in the subsequent calculations.

As described above, according to the system of the present invention, the longitudinal and lateral tilts viewed from the operator of the pile driver 10, not from the operator of the surveying instrument 14, are indicated on the display 17, allowing the operator of the pile driver to readily conduct a tilting control of the pile being driven. Also, there is no need to set up two surveying instruments for the tilting measurement of the pile or any tilt meter.

4. Other Embodiment(s)

The invention is not limited to the embodiment described above and may be modified and improved in various ways.

Figures 9A, 9B, 9C:
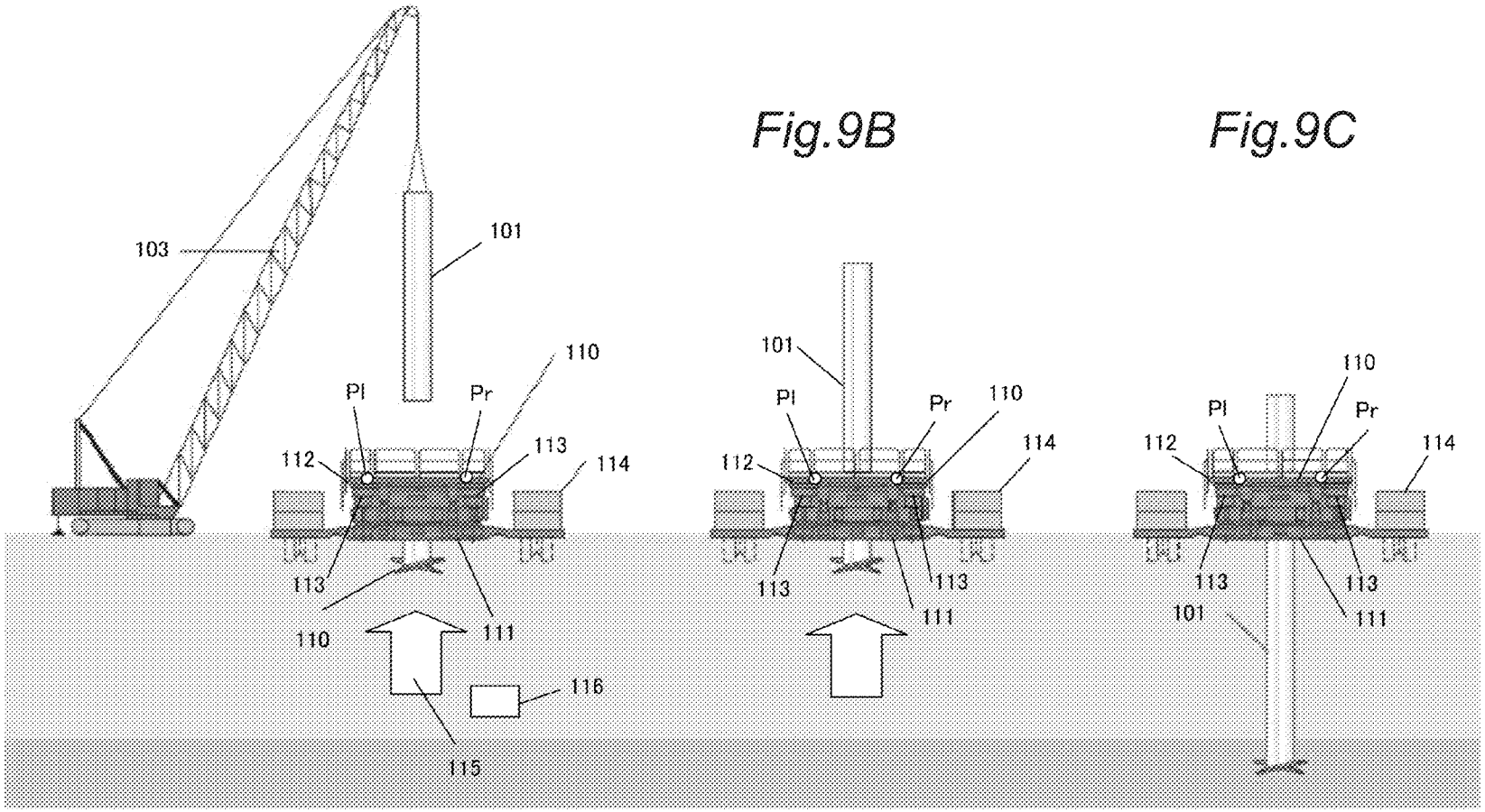
FIGS. 9A to 9C are diagrams showing another embodiment of the pile driver.

For example, FIGS. 9A to 9C show an embodiment which uses a rotatable, press-in pile driver 110. The pile driver 110, which is configured to press a pile into the ground while rotating the pile about its longitudinal axis, has rectangular upper and lower frames 111 and 112 each having a central opening, four hydraulic jacks 113 connecting the upper and lower frames 111 and 112, mechanisms (not shown) for holding and rotating the pile 101 placed vertically in the central openings of the frames, and a weight 114 for preventing an uplifting of the pile driver 101. In operation, the pile 101 is placed in the central opening by the auxiliary crane 103 while the weight 114 is placed on the lower frame 111. The pile 101 is then held by the holding mechanism on the upper frame 112 and then rotated by the rotating mechanism while it is pressed downwardly into the ground by the hydraulic jacks 113. With the rotating and the pressing forces, the pile 110 is pressed into the ground.

When using the pile driver 110, the collimation points or targets Pl and Pr, which are used for defining the operator coordinate system, are provided on respective positions on one side of the rectangular upper frame 112 and visible from the operator of the surveying instrument 14. Then, the operator of the pile driver 110 takes a position facing the targets Pl and Pr and views the pile driver 110 in a direction indicated by arrow 115 and operates the remote controller 116 while looking at the screens 21-23 on the display 17 shown in FIGS. 7 and 8 to control the movements of the hydraulic jacks 113 and also the tilting angles of the pile 101 in the longitudinal and lateral directions.

Figures 10A, 10B, 10C:
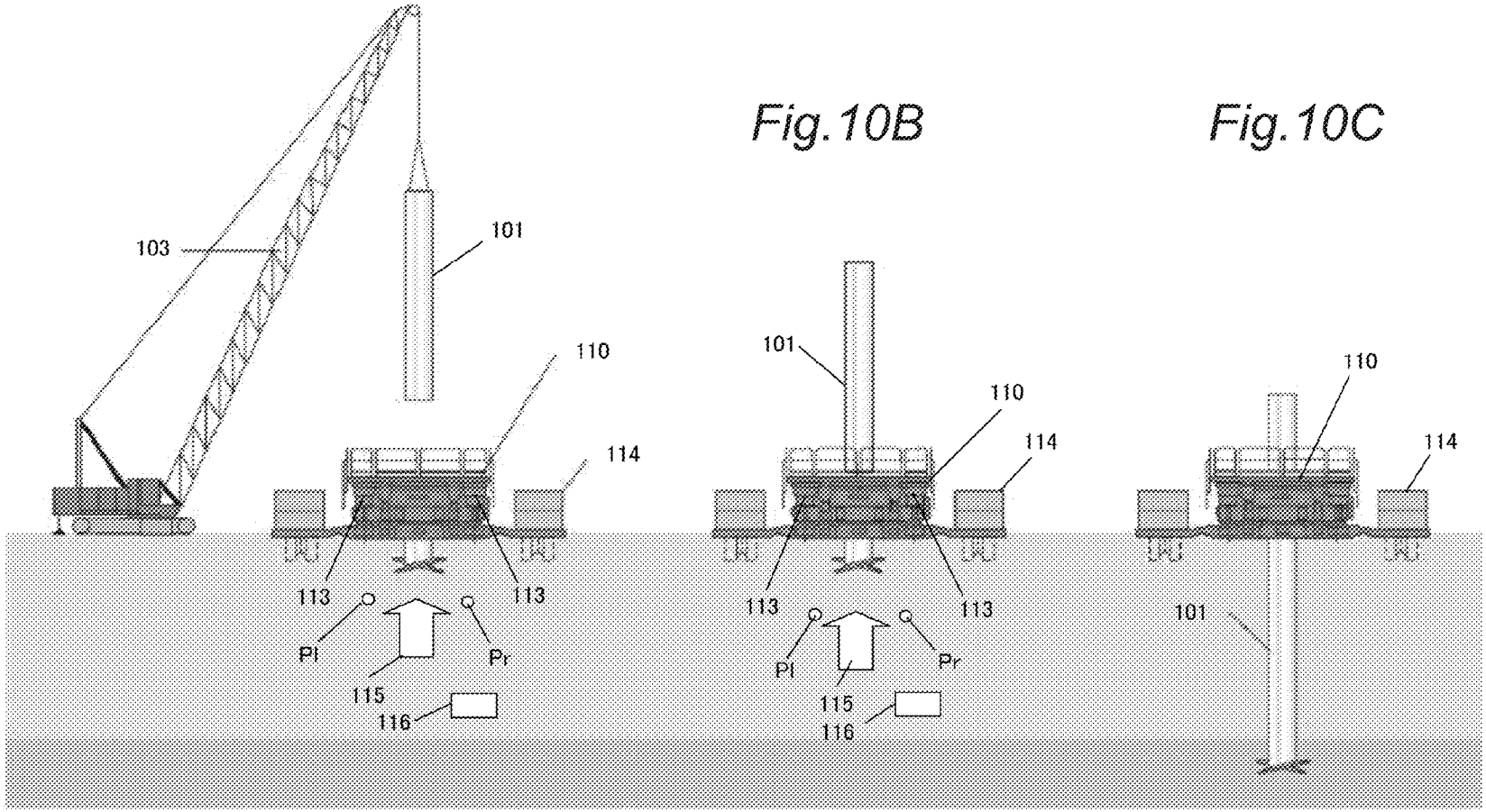
FIGS. 10A to 10C are diagrams showing another arrangement of targets.

The collimation targets Pl and Pr may not be provided on the pile driver 110. For example, as shown in FIGS. 10A to 10C, they may be provided on respective positions in an area before the front side of the pile driver 110. In this embodiment, the operator can reliably control the tilting of the pile in the operator coordinate system defined by the targets Pl and Pr.

Although the first processor 15 is provided in the first subsystem 12, one or more of the functions of the first processor 15 may be incorporated in the surveying instrument 14, in which the basic data and/or measurement data is transmitted from the surveying instrument 14 to the second subsystem 13. Also, one or more of the functions of the second processor 16 may be incorporated in the display unit 17, in which the basic data and/or measurement data is transmitted to the display unit 17 from the first processor 15 or the surveying instrument 14 incorporating one or more functions of the first processor 15. Further, the first processor 15 may be incorporated in the second processor 16 to form a single processor, in which the basic data and/or measurement data is transmitted from the surveying instrument 14 to the combined processor by wired or wireless communication. Alternatively, the second processor 16 may be incorporated in the first processor 15 to form a single processor, in which the basic data and/or measurement data is transmitted from the surveying instrument 14 to the combined processor by wired or wireless communication. Furthermore, one or more functions of the first and second processors 15 and 16 may be incorporated in the surveying instrument 14 or the display unit 17, in which the basic, measurement, and control data is transmitted from the surveying instrument 14 to the display unit 17. Moreover, although in the previous embodiment one operator operates the surveying instrument and the other operator operates the pile driver, a single operator may operate the surveying instrument and the pile driver in another embodiment shown in FIGS. 9 and 10.

5. Central Coordinate Measurement Technique

Discussions will be made to a central coordinate measurement technique.

1-1: Surveying Device

Figure 11:
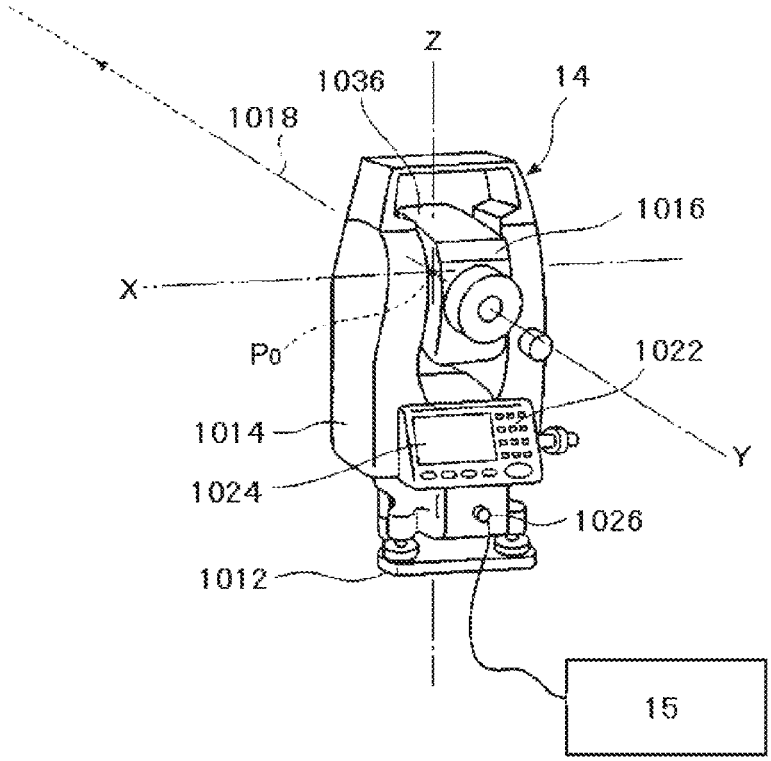
FIG. 11 is a perspective view of the surveying instrument.

FIG. 11 shows the surveying instrument 14. The surveying instrument 14 has a base 1012 which is releasably coupled and fixed on a tripod stand not shown, a main body 1014 coupled on the base 1012 for rotation about a vertical axis (Z-axis), and a telescope coupled on the main body 1014 for rotation about a horizontal axis (X-axis). The surveying instrument 14 includes a measurement means or section, indicated by reference numeral 1020 in FIG. 12, for measuring a distance from a reference point or coordinate Pm or mechanical reference point where three axes, i.e., a vertical axis (Z-axis), a first horizontal axis (X-axis), and a second horizontal axis (Y-axis) corresponding to the central optical axis 1018 of the telescope 1016 cross with each other to an object (not shown) collimated by the telescope 1016 and an angle of elevation which is an angle between the horizontal X-axis and the optical axis 1018. In the embodiment, the surveying instrument 14 has an input section 1022 for inputting data necessary for surveying, a display section 1024 for displaying results of the survey, and an output section 1026 for outputting the data input through the input section 1022 and the result data into another instruments.

Figure 12:
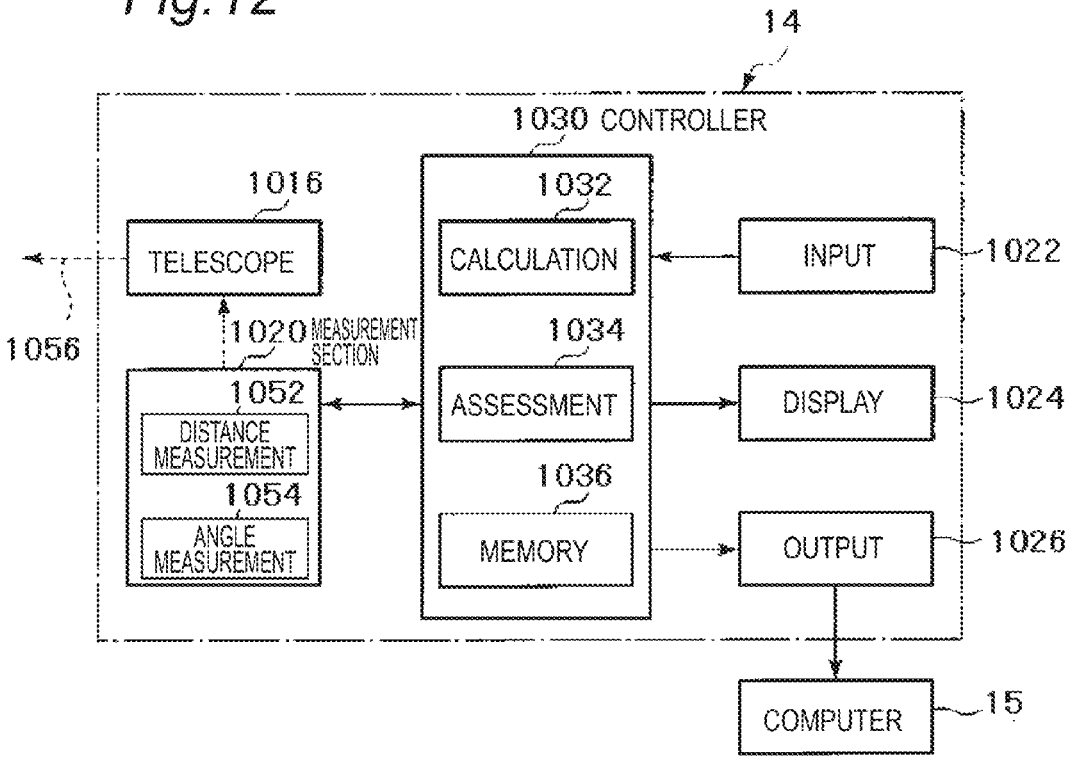
FIG. 12 is a block diagram showing a structure and function of the surveying instrument in shown in FIG. 11.

FIG. 12 is a block diagram showing the structural and functional elements of the surveying instrument 14. As shown, the surveying instrument 14 has a controller 1030. The controller 1030 is electrically communicated to the measurement section 1020, the input section 1022, and the display section 1024 to control those portions, which will be described in detail below. The control 1030 has a calculation section 1032 for calculating the coordinates of the internal centers of the pile, an assessment section 1034, and a memory section 1036 for storing programs and data necessary for the calculation and assessment. Although not shown, the surveying instrument 14 has other structural elements necessary for survey, such as leveling instrument and angle measurement section.

1-2: Telescope

Figure 13:
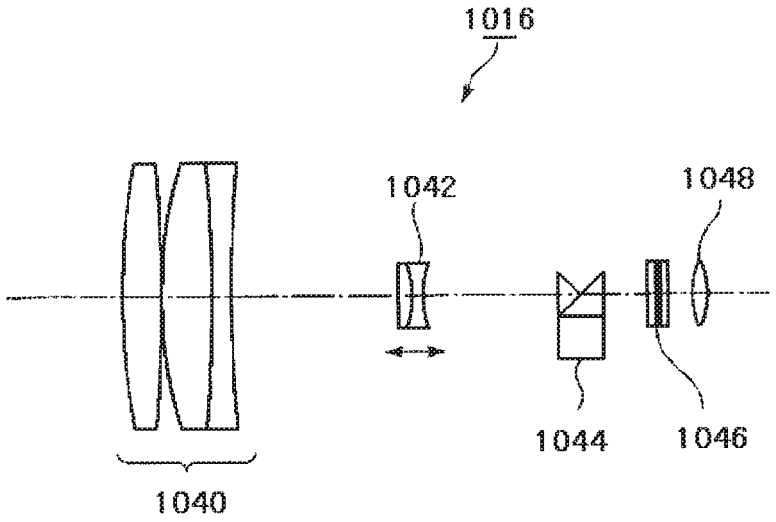
FIG. 13 is a schematic cross sectional view showing a structure of a telescope shown in FIG. 11.

FIG. 13 shows the schematic structure of the telescope 1016. As shown, the telescope 1016 has a cylindrical lens barrel which includes an object lens 1040, a focusing lens 1042, an erect prism 1044, a focusing plate or projection plate 1046, and an eyepiece lens 1048 arranged in this order from the object toward the survey operator, i.e., from left to right in the drawing, so that the collimated object image is transmitted through the object lens 1040, the focusing lens 1042, and the erect prism 1044 and focused on the focusing plate 1046, which allows the operator to see the enlarged object image through the eye piece lens 1048.

1-3: Focusing Plate and Reference Scale

Figure 14:
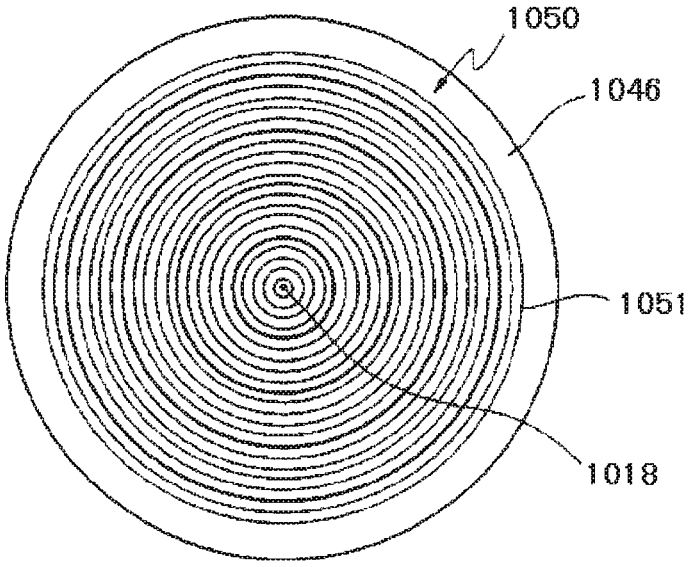
FIG. 14 is a diagram showing a reference scale projected on a focal plane in FIG. 13.

FIG. 14 shows a reference scale, generally indicated by reference numeral 1050, drawn on the focusing plate 1046. The reference scale 1050 has a number of concentric circles 1051 each drawn around the optical axis 1018. In the following descriptions, the n-th circle in order of distance from the optical axis 1018 is indicated as 1051(*n*). In this embodiment, the concentric circles 1051 are drawn at regular intervals in the radial direction crossing the optical axis 1018. The circles 1051 may not be regularly spaced away from each other. Also, although the circles 1051 are indicated by the heavy line every five circles in this embodiment, the width of the circle lines may be the same.

Figure 15:
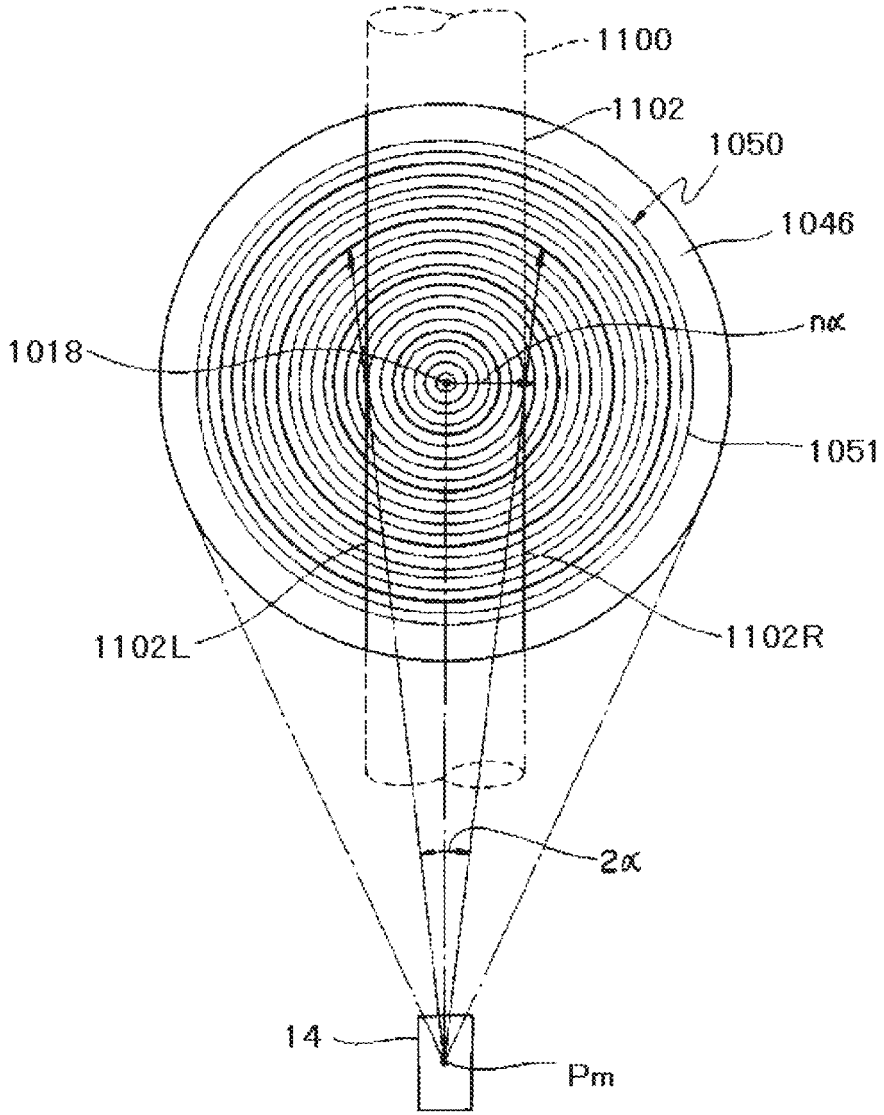
FIG. 15 is a diagram showing a relation between an image projected on the focal plane in FIG. 14 and the telescope.

As shown in FIG. 15, the telescope 1016 is adjusted so that the vertical, left and right side edges 1102L and 1102R of the pile image 1102 focused on the focusing lens 46 appear at an equal distance from the optical axis 1018. In this condition, the length of the lines drawn from the optical axis 1018 perpendicularly to the side edges 1102L and 1102R is indicated as a scale value $n_\alpha$. As indicated in the drawing, the scale number $n_\alpha$, is associated with the view angle $2\alpha$ of the pile 1100 when viewing it through telescope 1016.

In the embodiment shown in FIG. 15, the left and right edges 1102L and 1102R of the pile image 1102 are located on the seventh circle 1051(7). Then, the scale number $n_\alpha$ is "7", which is associated with the view angle $2\alpha$. The left and right edges 1102L and 1102R may not always on the circle. For example, when the left and right edges 1102L and 1102R occupies an intermediate position between the seventh circle 1051(7) and the eighth circle 1051(8), the scale number $n_\alpha$ is "7.5".

Figure 16:
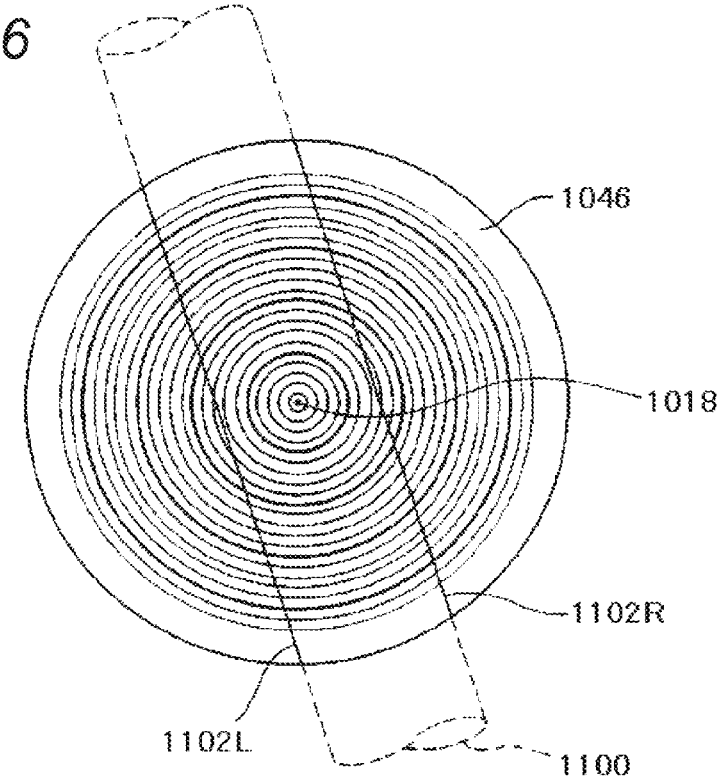
FIG. 16 is a diagram showing that the telescope is collimated at the tilted pile.

FIG. 15 shows the pile image 1102 which extends vertically. When the pile 1100 slants, as shown in FIG. 16 the image 1102 of the pile 1100 on the focusing plate 1046 also slants. In this instance, as discussed above the telescope 1016 is adjusted so that the left and right edges 1102L and 1102R appear at an equal distance from the optical axis 1018 and the length of the lines drawn from the optical axis 1018 perpendicularly to the side edges 1102L and 1102R is indicated as a scale value $n_\alpha$. In the illustrated embodiment, the left and right edges 1102L and 1102R position between the circles 1051(7) and 1051(8) and the scale number $n_\alpha$ is read as "7.2".

The relationship between the scale number n.α. and the view angle 2α is memorized in the memory section 1036 in the form of mathematical scheme or table. Then, when the operator inputs the scale number through the input section 1022, the calculation section 1032 uses the mathematical scheme or table memorized in the memory section 1036 to obtain the view angle 2α.

1-4: Measurement Section

Figure 17:
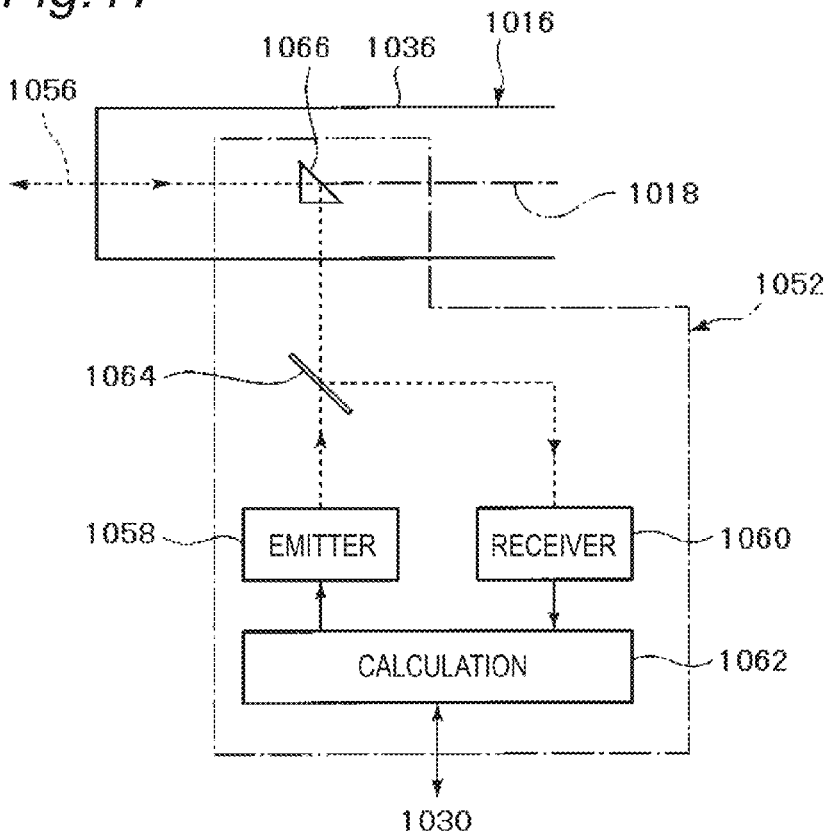
FIG. 17 is a diagram showing a structure of distance measurement subsection.

As shown in FIG. 12, the measurement section 1020 has a distance measurement sub-section 1052 for measuring the slope distance between the collimated object and the reference point Pm and the angle measurement sub-section 1054 for measuring the elevation angle θ (i.e., angle between the optical axis 1018 and the horizontal plane) and the azimuth angle β or horizontal angle between the optical axis and a certain of azimuth orientation. As shown in FIG. 17, the distance measurement sub-section 1052 has a light emitter 1058 or laser device made of laser diode, for example, for emitting a laser beam 1056, a light receiver 1060 for receiving the laser beam reflected from the object, a calculator 1062 for calculating the distance between the object and the reference point Pm from a time from the emission to the reception of the laser beam 1056, and an optical system 1064 for guiding the laser beam 1056 from the emitter 1058 along the optical axis 1018 of the telescope 1016 toward the object and also guiding the laser beam 1056 coming back from the object along the optical axis 1018 into the light receiver 1060. As shown, a prism 1066 is provided within the interior of the telescope 1016 to form a part of the optical system 1064 so that a path of the laser beam 1056 coincides with the optical axis 1018 of the telescope 1016. The distance calculation at the measurement section 1020 is not limited to use the time from the emission to the reception of light and it may be determined from the phase difference thereof.

1-5: Input Section

Figure 18:
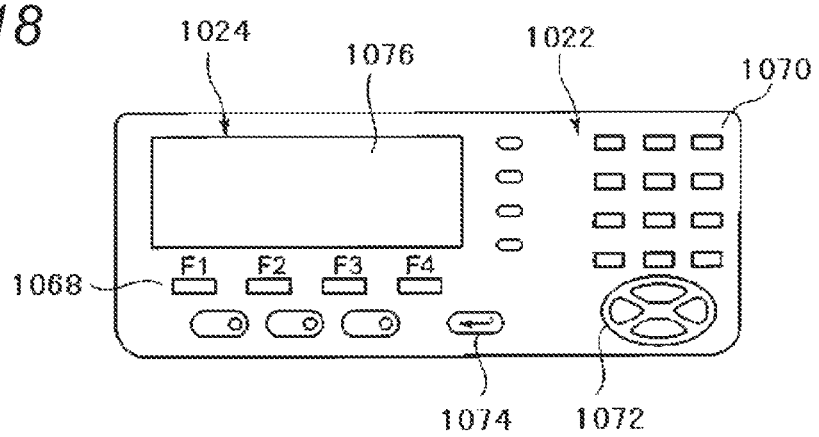
FIG. 18 is a diagram showing details of the input and display in FIG. 11.

As shown in FIG. 18, the input section 1022 has a number of keys including function keys 1068, ten keys 1070, cursor keys 1072, and enter key 1074. The function keys 1068 are used for starting the measurements which will be described below. The ten keys 1070 are used for entering the scale number n.α. read from the reference scale 1050 on the focusing plate 1046.

1-6: Display Section

Referring back to FIG. 11, the display section 1024 has a liquid crystal display for displaying the numerals measured at the measurement section 1020, such as distance, elevation angle, and azimuth angle, and the scale number $n_\alpha$ input through ten keys 1070, and other information such as results obtained at the calculation section 1032.

1-7: Output Section

The output section 1026 outputs various information such as measurement results, indicated at the display section 1024, and other information such as survey data memorized in the survey device, not indicated at the display section, to the first processor 15.

2-1: Calculation of Centers

Figure 19:
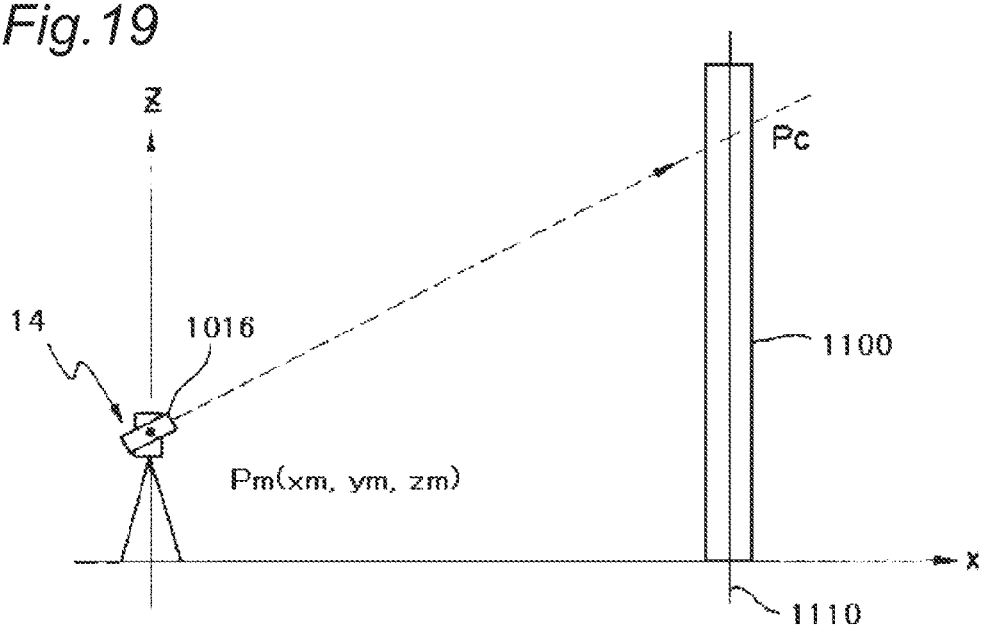
FIG. 19 is a diagram showing a condition in which the pile is collimated by an optical device.
Figure 20:
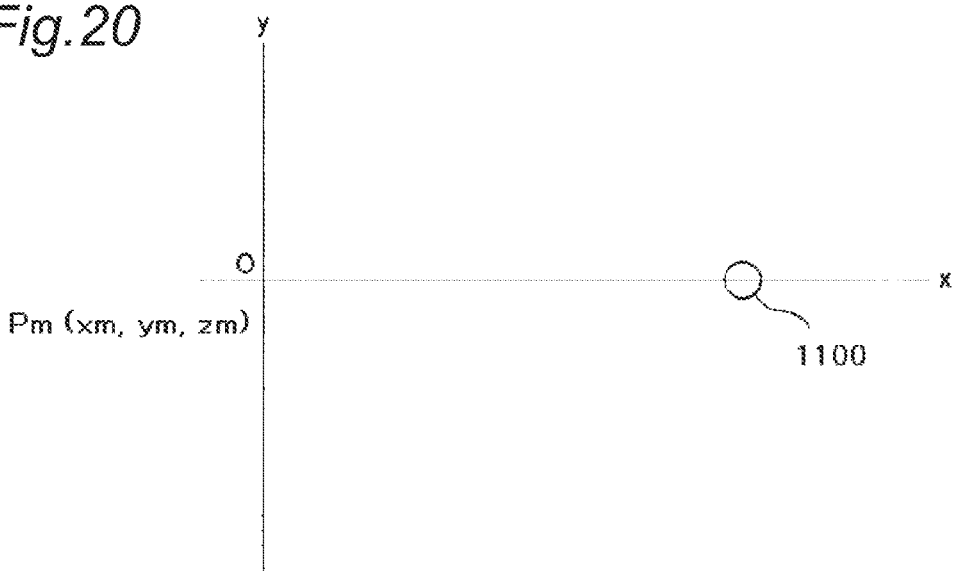
FIG. 20 is a diagram showing a relation between the basic coordinate system and the pile.

As shown in FIG. 19, descriptions will be made to a method for measuring central coordinates of the central axis 1110 in the pile 1100 at respective levels. First, the principle for the coordinate calculation will be described. For clarity, it is assumed that, as shown in FIG. 20, the centers of the pile 1100 at respective levels take respective positions on the X-Z plane, namely, the y-coordinate is always zero.

As shown in FIG. 19, the telescope 1016 is collimated at an upper portion of the pile 1100. In this instance, as shown in FIG. 21A, the surface center Ps at which the optical axis 1018 is collimated (i.e., the surface center being a surface point of the pile 1100 positioned on the optical axis 1018 when the telescope 1016 is adjusted so that the left and right edges 1102L and 1102R position at equal distance from the central axis 1018) and the internal center Pc of the pile 1100 on the optical axis 1018 have respective coordinates given by the following equations (1) and (2):

$$PS(xm+L\cos\theta, z0+L\sin\theta) \quad (1)$$

$$Pc(xm+L\cos\theta+r, zm+L\sin\theta+r\tan\theta) \quad (2)$$

Figures 21A, 21B:
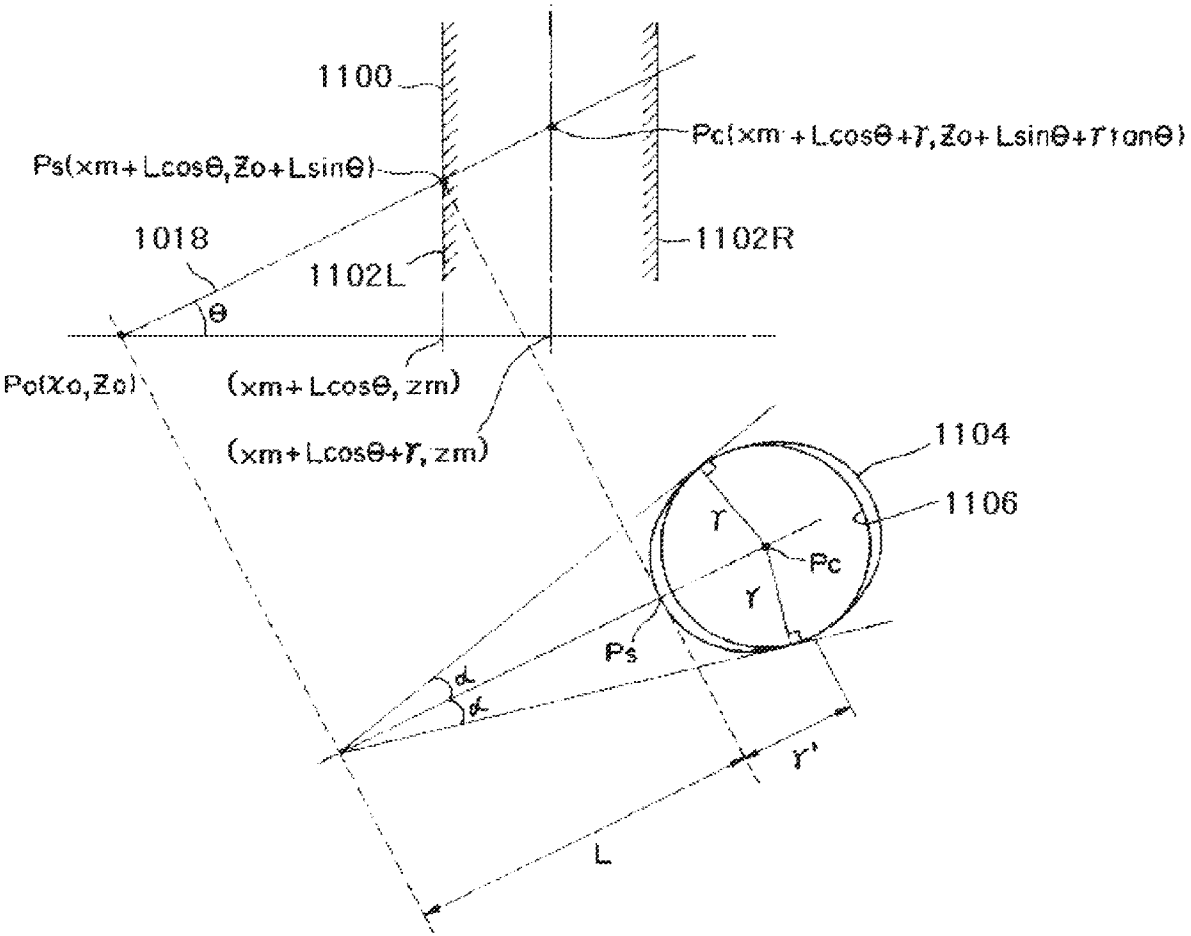
FIG. 21 is a diagram showing a principle for measurement.

FIG. 21B shows a slanted cross section 1104 on a plane which includes the optical axis and intersects at the elevation angle θ with the horizontal plane and a cross section 106 which includes the surface center Ps or the internal center Pc and positions on a horizontal plane including the surface center. As shown in the drawing, the cross section 106 is indicated by a perfect circle with a radius of r and the cross section 104 is indicated by an ellipse with a major axis length of 2r' and a minor axis length of 2r.

In this instance, as shown in FIG. 21B, the radius of the major axis r' of the ellipse 104, the slope distance L between the reference point Pm and the surface center Ps, the radius of the minor axis of the cross sections 104 and 106, and the view angle α of the pile image 1102 appeared on the focusing plate 1046 have a relationship given by the following equation (3):

$$r'=r/\sin\alpha-L \quad (3)$$

Referring to FIG. 21A, the radii r, r' and the elevation angle θ have a relationship given by the following equation (4):

$$r'=r/\cos\theta \quad (4)$$

From equations (3) and (4), the radius r of the cross section 1106 is given by the following equation (5):

$$r=L\sin\alpha\cos\theta/(\cos\theta-\sin\alpha) \quad (5)$$

Therefore, the coordinates Pci (xi, zi) of the internal center Pc on the optical axis 1018 is determined by substituting the radius r obtained from the equation (5) into the equation (2).

2-2: Operations at Controller

Figure 22:
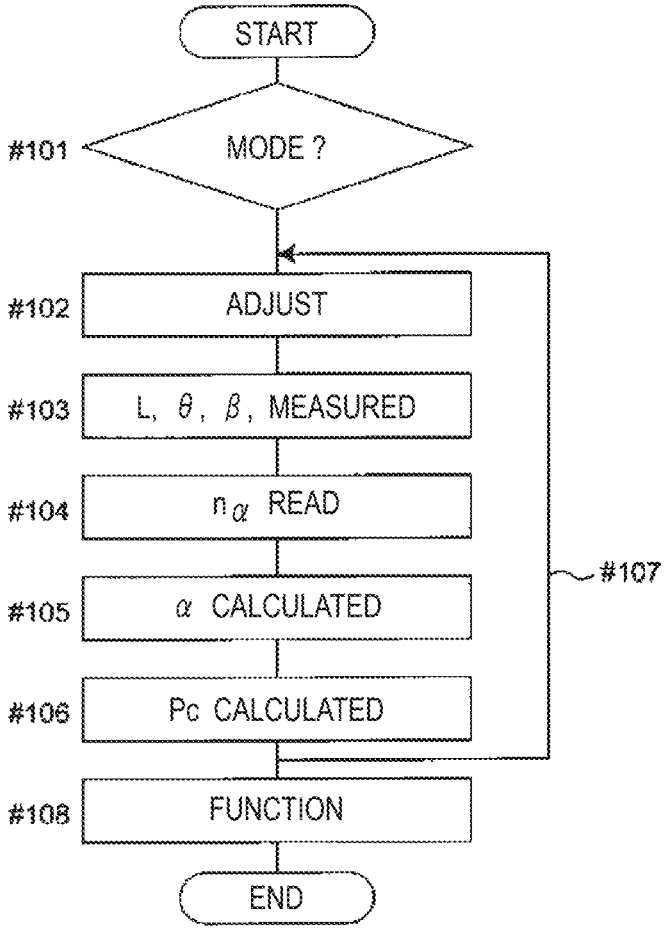
FIG. 22 is a diagram showing a process for determining such as centers on the longitudinal axis of the pile.

Referring to FIG. 22, descriptions will be made to the operations at the controller 1030.

At step S101, the a mode key (function key) at the input section 1022 is turned on to determine the coordinates of the central axis. Based on the turn-on signal, the controller 1030 starts the central-axis, coordinate measuring mode.

At step S102, the measuring point on the pile 1100 is collimated (see FIG. 19). As shown in FIGS. 5 and 6, the telescope 1016 is adjusted so that optical axis 1018 places at the internal center Pc of the pile 1100, namely, the left and right edges 1102L and 1102R position at an equal distance from the optical axis 1018.

At step S103, the distance measuring key (function key) at the input section 1022 is turned on. Based on the turn-on signal, the controller 1030 drives the distance measurement sub-section 52 to measure the distance L from the reference point Pm to the surface center Ps of the pile on the optical axis 1018. The measured distance L is stored in the memory section 1036. Also, the controller 1030 drives the angle measurement sub-section 54 to measure the elevation angle θ and the azimuth angle β, which are then stored in the memory section 1036.

At step S104, the operator reads the scale number $n_\alpha$, which is input by means of the ten keys 1070 at the input section 1022.

At step S105, the calculation section 1032 calculates the view angle 2α from the input scale number $n_\alpha$ according to the mathematical scheme or the table. The calculated view angle 2α is stored in the memory section 1036.

At step S106, the calculation section 1032 retrieves the distance L, the elevation angle θ and the azimuth angle β and calculates the coordinates of the internal center Pc on the optical axis 1018 by using the equation (2) stored in the memory section 1036. The determined coordinates of the internal center Pc is stored in the memory section 1036.

At step S107, the operations from steps 102 to 106 are performed to point P2 on the pile 1100.

At step S108, after reading the coordinates of the internal centers, the calculation section 1032 retrieves the coordinates of the internal centers of the pile 1100, stored in the memory section 1036, to determine a function (three-dimensional function) of the longitudinal axis connecting the internal centers.

PARTS LIST

1: system
10: pile driver
12: first subsystem
13: second subsystem
14: surveying instrument
15: first processor
16: second processor
17: display
18: benchmark
19 collimation point
20: display
21-23: displaying section
101: pile
102: wing
103: auxiliary crane
104: auger motor
105: rotation cap
106: resting arm
107: hydraulic cylinder
108: guide
109: longitudinal axis
110: pile driver
P1, P2: collimation point
Pl, Pr: target

The invention claimed is:

1. A method for providing operational information to an operator of a pile driver for driving a pile into the ground, the method comprising the steps of:

(a) setting a total station;

(b) determining a mechanical coordinate of the total station;

(c) defining a first coordinate system, the first coordinate system having a coordinate origin thereof at the mechanical coordinate;

(d) causing the total station to collimate a first central point on a surface of the pile and determine a first coordinate of the first central point in the first coordinate system;

(e) causing the total station to collimate a second central point on the surface of the pile and determine a second coordinate of the second central point in the first coordinate system;

(f) setting first and second targets on the pile driver or respective positions away from the pile driver;

(g) causing the total station to determine coordinates of the first and second targets in the first coordinate system;

(h) defining a second coordinate system, the second coordinate system having a first horizontal direction parallel to the a vertical plane including the coordinates of the first and second targets, a second horizontal direction orthogonal to the first horizontal direction, and a reference point at which the pile is to be driven into the ground;

(i) converting a first coordinate data in the first coordinate system into the second coordinate system to determine a second coordinate data in the second coordinate system, the first coordinate data being coordinates of first and second centers defined from the first and second coordinates; and (j) determining an amount of tilt of the pile in the second coordinate system using the second coordinate data.

2. The method of claim 1, further comprising displaying the amount of tile.

3. The method of claim 1, wherein the amount of tile includes a first amount of tilt in a vertical plane including the first horizontal direction and a second amount of tilt in a vertical plane including the second horizontal direction which define the second coordinate system.

4. The method in claim 1, wherein the first center is a lowermost point of the pile which is positioned on the longitudinal axis of the pile and the second center is an uppermost point of the pile which is positioned on the longitudinal axis of the pile.

5. The method in claim 1, wherein the first central point is positioned a certain distance away from an uppermost end of the pile.

6. The method in claim 1, wherein the step (i) includes:

(i1) defining the longitudinal axis in the first coordinate system using the first and second coordinates;

(i2) determining coordinate data of the first and second centers in the first coordinate system; and (i3) converting the coordinate data of the first and second centers in the first coordinate system into the second coordinates system to obtain the coordinate data in the second coordinates system.

7. The method of claim 6, wherein the step (i1) comprising:

using the first and second coordinates and the mechanical coordinate to define a collimation plane which includes the first and second central points and the mechanical reference point;

determining coordinates of axial points on the longitudinal axis, the axial points being spaced a radius of the pile away from the first and second central points in a direction orthogonal to a line connecting the first and second central points; and using the coordinates of the axial points on the longitudinal axis to define the longitudinal axis.

8. A system for providing operational information to an operator of a pile driver for driving a pile into the ground, comprising:

a total station; and a processor for determining an amount of tilt of the pile using data obtained by the total station;

the processor configured to:

define a first coordinate system having a coordinate origin thereof at a mechanical coordinate of the total station;

obtain data of a first coordinate of a first point of the pile and a second coordinate of a second point of the pile in the first coordinate system, the first and second points appearing on a collimation axis of the total station when the collimation axis is collimated at first and second centers on the pile, respectively;

obtain coordinates of first and second targets provided at respective positions on or away from the pile driver using data obtained by collimating the first and second targets by the total station;

define a second coordinate system by using a first horizontal direction parallel to a vertical plane including the coordinates of the first and second targets, a second horizontal direction orthogonal to the first horizontal direction, and a reference point at which the pile is to be driven into the ground;

convert a first coordinate data in the first coordinate system into the second coordinate system to obtain a corresponding second coordinate data into the second coordinate system, respectively, the first and second coordinate data being coordinate data of the first and second central points and on a longitudinal axis of the pile corresponding to the first and second coordinates, respectively; and determine an amount of tilt of the pile in the second coordinate system using the second coordinate data.

9. The system of claim 8, further comprising a display for displaying the amount of tilt of the pile.

10. The system of claim 9, wherein the amount of tile includes a first amount of tilt in a vertical plane in the first horizontal direction and a second amount of tilt in a vertical plane in the second horizontal direction which define the second coordinate system.

11. The system in claim 8, wherein the first center is a lowermost point of the pile which is positioned on the longitudinal axis of the pile and the second center is an uppermost point of the pile which is positioned on the longitudinal axis of the pile.

12. The system in claim 8, wherein the first point is positioned a certain distance away from an uppermost end of the pile.

13. The system in claim 8, wherein in determining the amount of tilt of the pile in the second coordinate system, the processor is configured to:

define the longitudinal axis in the first coordinate system using the first and second coordinates;

determine coordinate data of the first and second centers in the first coordinate system; and convert the coordinate data of the first and second centers in the first coordinate system into the second coordinates system to obtain the coordinate data in the second coordinates system to obtain the coordinate data.

14. The system of claim 13, wherein in defining the longitudinal axis, the processor is configured to:

use the first and second coordinates and the mechanical coordinate to define a collimation plane which includes the first and second points and the mechanical reference point;

determine coordinates of the points on the longitudinal axis, the points being spaced a radius (r) of the pile away from the first and second points in a direction orthogonal to a line connecting the first and second points;

use the coordinates of the points on the longitudinal axis to define the longitudinal axis.

* * * * *